US005331714A

United States Patent [19]

Essex et al.

[11] Patent Number: 5,331,714

[45] Date of Patent: Jul. 26, 1994

[54] STACKED LOOPED HOSE RACK FOR UPRIGHT CLEANER

[75] Inventors: John D. Essex, North Canton; Darwin T. McKnight, Louisville, both of Ohio

[73] Assignee: The Hoover Company, North Canton, Ohio

[21] Appl. No.: 954,821

[22] Filed: Oct. 1, 1992

Related U.S. Application Data

[63] Continuation-in-part of Ser. No. 702,710, May 20, 1991, Pat. No. D. 330,615.

[51] Int. Cl.[5] ..... A47L 9/00

[52] U.S. Cl. ..... 15/323

[58] Field of Search ..... 15/323, 357, 334, 335, 15/350, 351; D32/22, 31, 32, 33

[56] References Cited

U.S. PATENT DOCUMENTS

| | | | |
|---|---|---|---|
| D. 272,572 | 2/1984 | Parise | D32/31 |
| D. 309,203 | 7/1990 | Goodrich | D32/22 |
| D. 313,681 | 1/1991 | McKnight | D32/22 |
| D. 329,511 | 9/1992 | McKnight | D32/31 |
| D. 330,615 | 10/1992 | Essex et al. | D32/31 |
| 2,003,147 | 5/1935 | Holm-Hansen | 242/85 |
| 2,946,071 | 7/1960 | Nilsson | 15/49 |
| 4,809,393 | 3/1989 | Goodrich et al. | 15/323 |
| 5,137,156 | 8/1992 | Riczinger et al. | 211/13 |

FOREIGN PATENT DOCUMENTS 2425227 5/1978 France .

OTHER PUBLICATIONS

USA Electrolux Advantage—Purchased Oct. 31, 1989.

*Primary Examiner*—Stephen F. Gerrity
*Assistant Examiner*—Patrick Brinson

[57] ABSTRACT

A stacked looped hose rack for upright vacuum cleaners provides a top hose receptacle, a bottom hose receptacle, and an intermediate hose receptacle, all three attached to the handle assembly of the upright cleaner. The top hose receptacle is rotatable to provide for a quick dump or release of the hose spirally wrapped around the top and bottom receptacles, and through the intermediate one. The bottom receptacle is in the form of a spool, the top receptacle is in the form of a generally elliptical spool, and the middle receptacle is provided with a pair of channels in H-type configuration to receive the hose as it passes therethrough.

13 Claims, 3 Drawing Sheets

14
10
12
34
58
18
20
28
16
60
12
56
34
32
34
30
22
34

14
26
10
24
12
20
60
34
28
32
41
36
38
46
22
30

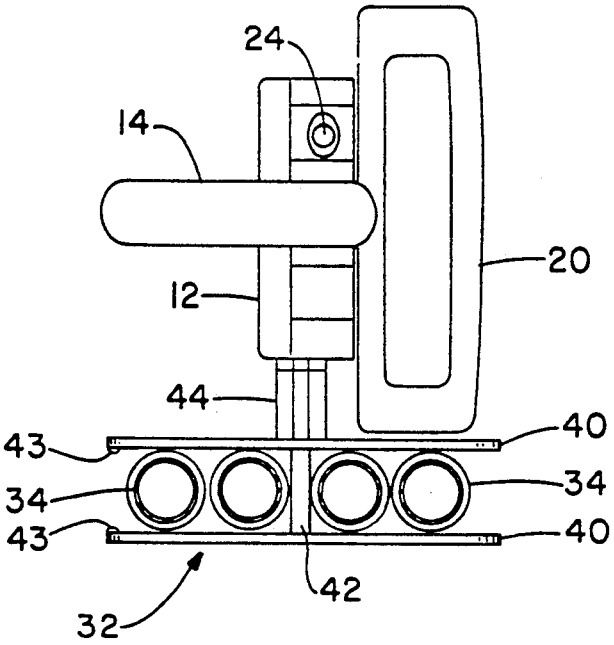
FIG.-5
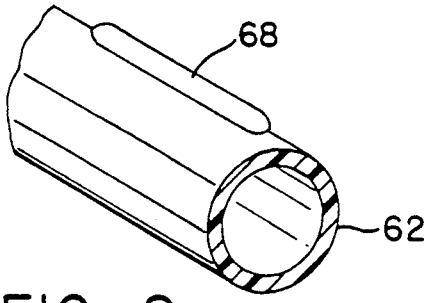
FIG.-9
FIG.-6
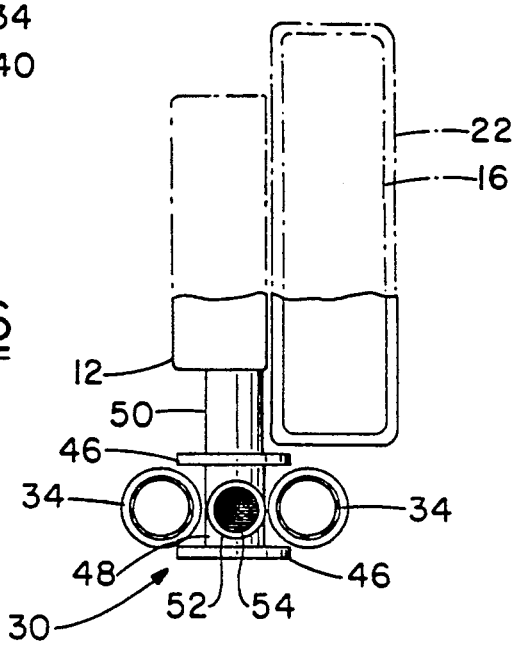
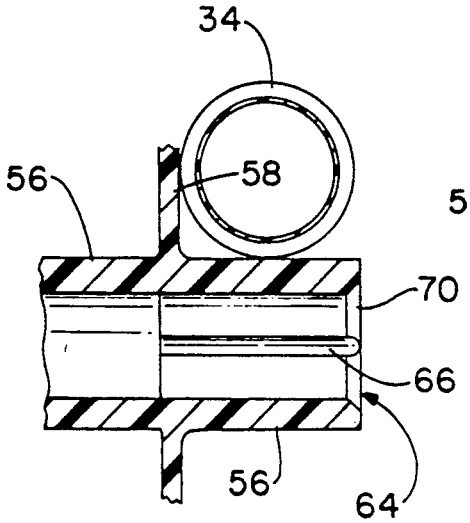
FIG.-7
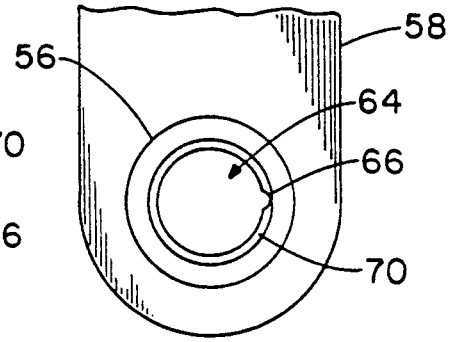
FIG.-8

STACKED LOOPED HOSE RACK FOR UPRIGHT CLEANER

RELATED APPLICATIONS

This application is a continuation-in-part of application Ser. No. 07/702,710, filed May 20, 1991, now U.S. Pat. No. Des. 330,615 and owned by a common assignee.

TECHNICAL FIELD

The invention herein resides in the art of floor care devices and, more particularly, to upright vacuum cleaners. Specifically, the invention pertains to a hose rack for an upright vacuum cleaner in which the hose is spirally wound and vertically stacked upon itself and maintained in such posture. Particularly, the invention relates to such a hose rack which extends from a side of the upper handle assembly of the vacuum cleaner and which includes a quick dump feature for releasing the hose therefrom.

BACKGROUND ART

It is well known that vacuum cleaners typically fall in three categories, routinely referred to as uprights, canisters, and sticks. Upright vacuum cleaners are generally perceived as providing superior floor care, while canisters provide a certain degree of flexibility in use, accommodating both floor care and above floor cleaning. Stick cleaners are generally perceived as providing for quick cleanup of floor surfaces and the like, and are appreciated for their ease of storage and ready availability.

The present trend in vacuum cleaners is to provide uprights with above-floor cleaning capabilities. To extend the utility of upright cleaners to this arena, a hose, wands, and associated tools must typically be provided. Such a combination allows the vacuum cleaner to perform the outstanding floor care typically characterizing an upright cleaner, while also providing the flexibility of utility which has previously characterized canister cleaners. The storage of the hose and associated tools implemented with the vacuum cleaner is critical so that the same are readily available for immediate use, but without impeding the operability of the cleaner itself.

In the vacuum cleaner art, the mounting and storage of cords and hoses on the cleaner is well known. The implementation of separated receiving hooks for electrical power cords is known from U.S. Pat. No. 2,003,147, while the provision of a quick release mechanism for such power cords is shown by U.S. Pat. No. 2,946,071. Additionally, the side mounting of the vacuum hose on an upright cleaner in which a single wrap of the hose is provided on an extensive continuous contoured receptacle is shown in U.S. Pat. No. Des. 313,681. However, a single wrap of hose is sufficient only for an extendable or stretchable hose. For hoses which can not be elongated in use, the size or number of wraps must be increased, while remaining unobstructive to the utility of the cleaner.

Despite the prior teachings, there is an absence in the vacuum cleaner art of a hose rack for an upright cleaner which accommodates substantial hose length in a compact area by spirally wrapping the hose upon itself There is particularly absent such a hose rack in which the spiral wrap of the hose is vertically stacked upon itself. There is also absent such a hose rack in which the spiral wrap of the hose is horizontally wound upon itself. There is also absent such a rack which allows for the quick release of the hose for access in use. The art is in need of a hose rack which fills the voids identified above and which allows for an orderly storage of the hose upon a rack which is simplistic in design, inexpensive to construct, and easy to implement with presently existing upright vacuum cleaners.

DISCLOSURE OF INVENTION

In light of the foregoing, it is a first aspect of the invention to provide a stacked looped hose rack for upright cleaners which is capable of accommodating substantial hose lengths in a compact area by spirally wrapping the hose on itself.

An additional aspect of the invention is the provision of a stacked looped hose rack for upright vacuum cleaners in which the hose is vertically stacked upon itself, confining the hose stack to an unobstructive envelope.

Another aspect of the invention is the provision of a stacked looped hose rack for upright cleaners which allows for quick release of the hose for ease of access and use.

Still a further aspect of the invention is the provision of a stacked looped hose rack for upright cleaners which allows for the orderly storage of the hose and which is simplistic in design, inexpensive to construct, and easy to implement with presently existing vacuum cleaners.

The foregoing and other aspects of the invention which will become apparent as the detailed description proceeds are achieved by a hose and rack assembly for an upright vacuum cleaner, comprising: a hose having first and second ends; and support means attached to the vacuum cleaner for receiving and maintaining said hose, said first end of said hose being connected to said support means, said support means including release means for effecting a quick release of said hose from said support means.

Other aspects of the invention which will become apparent herein are attained by the improvement of a hose and rack assembly in an upright vacuum cleaner, comprising: a top hose receptacle; a bottom hose receptacle; a middle hose receptacle interpositioned between said top and bottom hose receptacles; and a hose having a first end thereof removably connected to the vacuum cleaner and being spirally wrapped between said top and bottom hose receptacles and received within said middle hose receptacle.

DESCRIPTION OF DRAWINGS

For a complete understanding of the objects, techniques, and structure of the invention reference should be made to the following detailed description and accompanying drawings wherein:

FIG. 5 is a top view in partial section of the assembly of FIG. 1 showing the hose received on the middle H-shaped connector;

FIG. 6 is a partial plan view of the bottom hose mount and connector at the wrapping spool according to the invention;

FIG. 7 is a cross sectional view of the detented hose dump boss;

FIG. 8 is a side view of the hose dump boss of FIG. 7 with the outer flange removed; and FIG. 9 is a partial sectional view of the protruding hose dump boss adapted to mate with the detented hose dump boss of FIGS. 7 and 8.

BEST MODE FOR CARRYING OUT THE INVENTION

Figure 1:
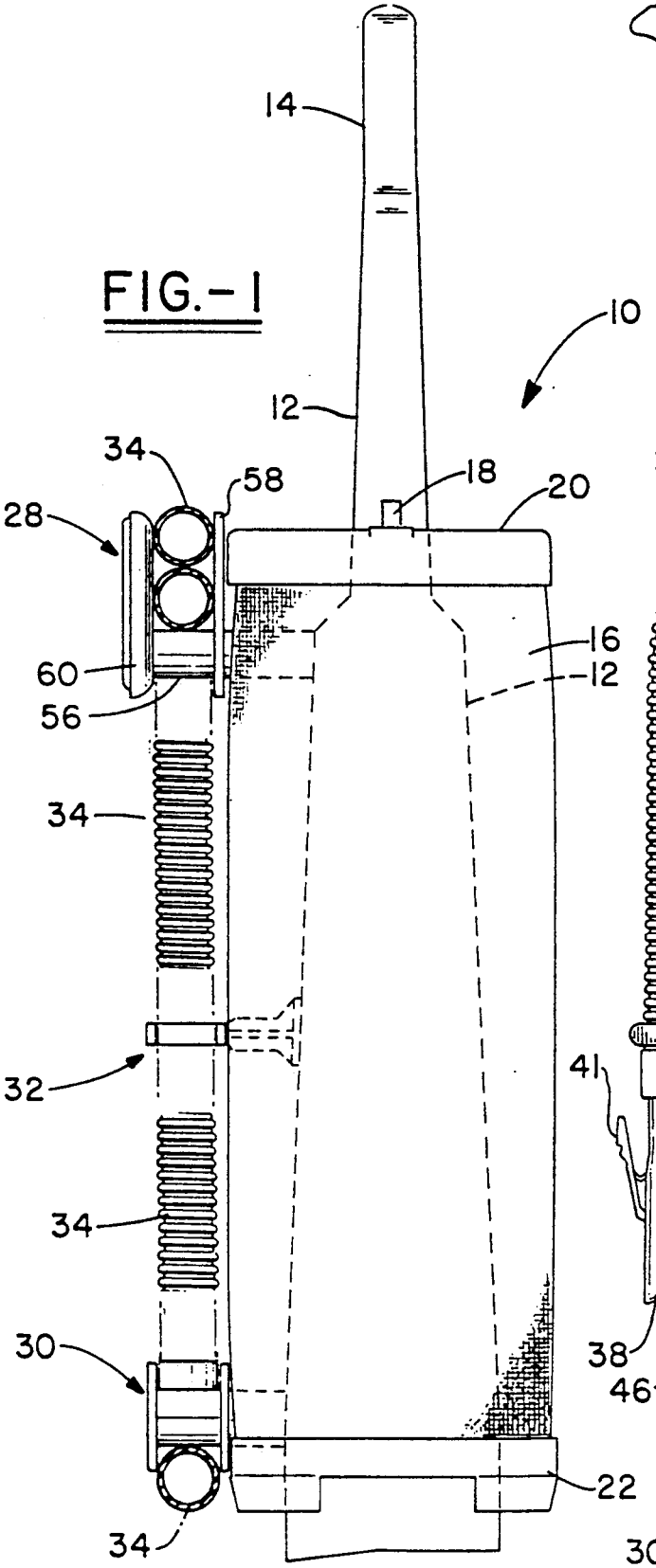
FIG. 1 is a front elevational view in partial section of a handle portion of an upright vacuum cleaner, including the dust bag and hose rack according to the invention.

Referring now to the drawings and more particularly FIGS. 1–4, it can be seen that an upright cleaner according to the invention is designated generally by the numeral 10. As shown, a handle assembly 12 extends to a hand grip 14 to be seized in use by the hand of an operator. A jacket 16, of cloth or other air pervious material, is mounted to the front of the handle assembly 12 and encases a dust bag or bag type of filter. The jacket 16 is retained to the handle assembly 12 by means of a bag hook 18 or appropriate tab at a top end thereof. Those skilled in the art will appreciate that the bag hook 18 interconnects between the handle assembly 12 and a top cap 20 received upon the jacket 16. Of course, a bottom cap 22 is maintained at the bottom of the jacket 16 and is also appropriately affixed to the handle assembly 12.

Figure 2:
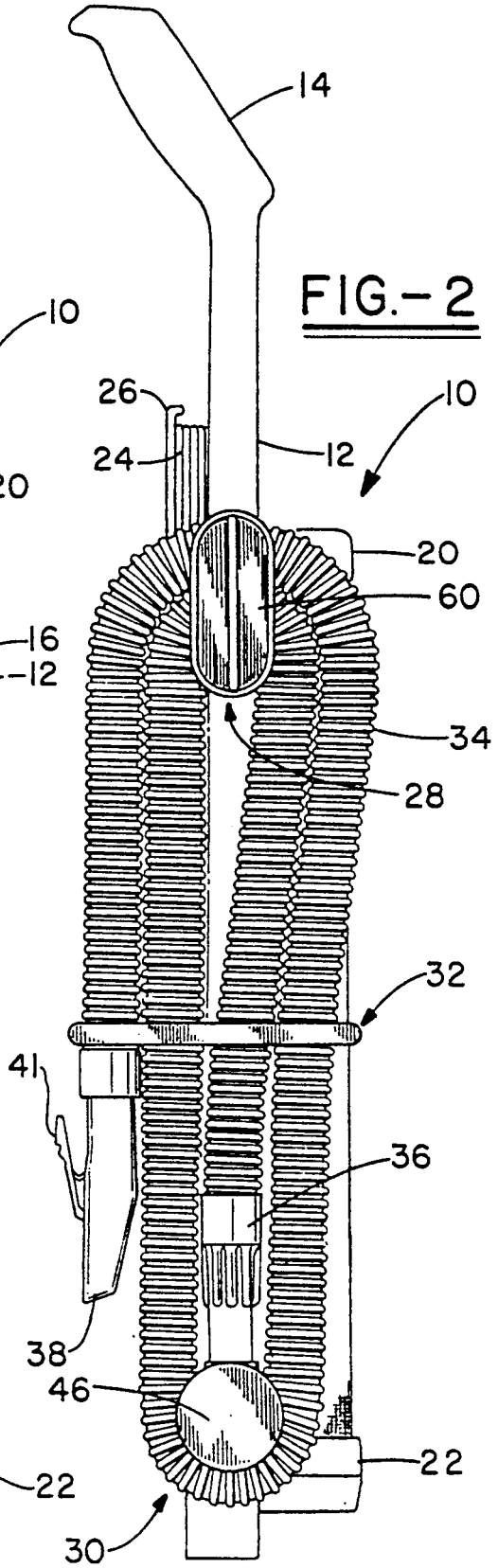
FIG. 2 is a side elevational view of the assembly of FIG. 1.
Figure 3:
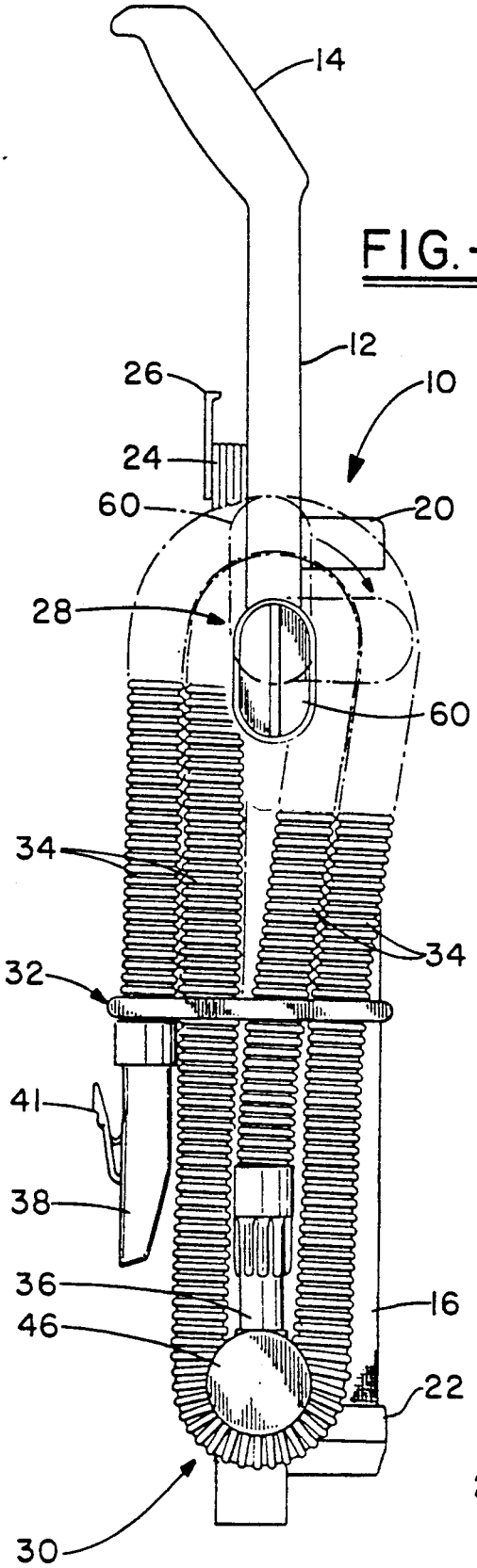
FIG. 3 is a side elevational view of the assembly of FIG. 1 showing the hose boss in a hose dump position.
Figure 4:
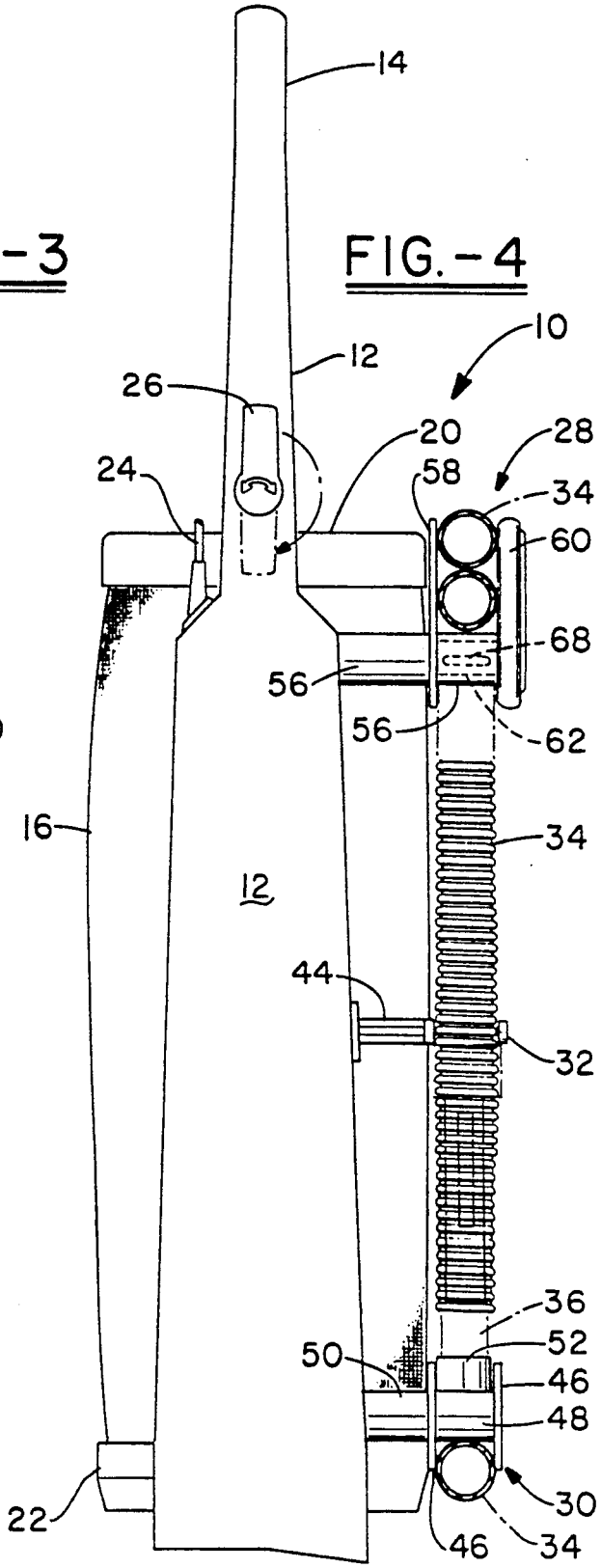
FIG. 4 is a rear elevational view of the assembly of FIG. 1 showing the cord removed.

A power cord 24 is provided to conduct wall current to the motor of an appropriate vacuum generating and/or agitating source such as a motor or the like (not shown). As shown in FIGS. 2 and 3, the cord 24 is wrapped upon a cord hook 26 which, as illustrated in FIG. 4, may be rotatable to provide for a "quick dump" release of the cord 24.

Those skilled in the art will readily appreciate that the handle assembly 12 is connected at the end thereof opposite the handle 14 to a fan and motor housing which also carries a rotating brush, agitator, or the like. Since the specific structure of those features is not critical for an appreciation or an understanding of the instant invention, the same have not been shown in the drawing. Provided as an important feature of the instant invention is a top hose mount or receptacle 28 which is spaced from a bottom hose mount or receptacle 30. Interpositioned therebetween is a middle or intermediate hose retainer or receptacle 32. As best illustrated in FIG. 1, the various receptacles or mounts 28, 30, 32 are fixedly secured to the handle assembly 12 and extend from a side thereof adjacent a side edge portion of the bag 16.

A hose 34 is received at one end 36 thereof within a socket or retainer. Suffice it to say that the retention of the end 36 of the hose 34 facilitates wrapping or coiling of the hose 34 and vertically stacking the same upon itself in a manner which will become apparent below.

With reference now to FIG. 5, it can be seen that the middle hose retainer 32 is configured in the shape of an H, having pairs of parallel legs 40 centrally interconnected by a center spacer 42. Accordingly, the legs 40 and spacer 42 define two channels, one on each side of the spacer 42, with the legs 40 being of sufficient length to accommodate, in the preferred embodiment of the invention, two diameters of the hose 34. Accordingly, the hose retainer 32, affixed to the handle portion 12 by means of the arm 44, provides for the receipt and maintenance of the hose 34 as it extends from the bottom hose mount 30 to the top hose mount 28, back around the bottom hose mount 30, and again over the top hose mount 28, providing for a spiral wrap of the hose 34 upon itself. The channels defined by the legs 40 and spacer 42, being sufficiently spaced to accommodate two layers of the hose 34 in each channel, assures such a spiral wrap.

As shown in FIGS. 2 and 3, the hose 34 is wrapped counter clockwise about the hose mounts 28, 30, 32. Such a wrap allows the hose end 38 to separate from the spiral wrap and retention of the middle retainer 32 when the cleaner 10 is in use with the handle assembly 12 tilted rearwardly. Of course, a clockwise wrap would prevent such separation. In any event, inwardly extending buttons or protrusions 43 may extend from the respective legs 40 at the rearward open end of the channels defined thereby, as shown in FIG. 5. The buttons 43 close the channel to a width less than the diameter of the hose 34, assuring that the hose remain wrapped in the channel. The rounded nature of the buttons 43, when engaged by the hose 34 during the wrapping procedure, cause the rearward portions of the legs 40 to deflect sufficiently to accommodate hose insertion.

With reference now to FIG. 6, it can be appreciated that the bottom hose mount 30 comprises a pair of circular flanges or discs 46 axially spaced apart upon a core 48 which extends from a tubular shaft 50 which is fixed to the handle assembly 12. Accordingly, the bottom hose mount 30 comprises a spool defined by the parallel circular end flanges 46 disposed at opposite ends of the core 48. In the preferred embodiment of the invention, the flanges 46 are configured with sufficient diameter to confine the hose 34 when received about the core 48. Of particular interest to the instant invention is the provision of a nipple 52 extending orthogonally from the core 48 and being of a tubular nature with a bore 54 therein serving as a socket or retainer for the end 36 of the hose 34 to facilitate wrapping and maintenance of the hose 36 upon the hose rack of the invention.

With continued reference to FIGS. 1–4, and additional reference to FIGS. 7–9, the specific configuration of the top hose mount or receptacle 28 can be achieved. As shown, a tubular shaft 56 is fixed to the handle assembly 12 and is fixedly connected to an inner flange 58. The fixed flange 58 may be of any suitable geometric configuration, but it is preferably of an oblong configuration. As best shown in FIGS. 1 and 4, the flange 58 is preferably secured to the shaft 56 near one end of the oblong configuration.

An outer flange 60, preferably of similar geometric configuration to the flange 58, has a shaft 62 extending therefrom and is adapted to be received within the bore 64 of the shaft 56. A detent 66 is provided in an inner circumferential surface of the bore 64 and is adapted to matingly engage with and receive a protruding boss 68 extending from the outer surface of the shaft 62. Insertion of the shaft 62 into the bore 64 is accommodated by means of the tapered lip 70 about the exposed end portion of the tubular shaft 56 as shown.

The positioning of the detent 66 and the protruding boss 68 is such that the two releasably interengage when the outer flange 60 is vertical and in alignment with the flange 58, as best shown in FIGS. 1, 2 and 4. The detent 66 and protruding boss 68 allow for rotation of the flange 60, as shown in FIG. 3, the same accommodating a quick dump or easy release of the spirally wrapped hose 34 from the top hose mount 28. The eccentric position of the shaft 62 at a bottom edge portion of the oblong flange 60 allows for such dumping in the manner shown in FIG. 3.

It will be readily appreciated from a view of FIGS. 1–4 that the spacing of the flanges 58, 60 of the top hose mount 28 and of the legs 40 defining the channels of the intermediate hose retainer 32 are slightly greater than the outside diameter of the hose 34 to allow ease of insertion of the hose therebetween, while also providing for a reasonable retainment therein. Additionally, the depth of the channel and of the receptacle defined between the flanges 58, 60 and the tubular shaft 56 is equal to approximately twice the outside diameter of the hose 34 to accommodate the vertical double wrap as shown in the drawings. Since only a single wrap is required at the spool of the bottom hose mount 30, the extension of the circular flanges or discs 36 beyond the core 48 need only be approximately equal to the radius of the hose 34, with the spacing between the flanges being slightly greater than the diameter thereof.

It should now be appreciated that the hose 34 may be stored as shown in FIG. 2 when the upright cleaner 10 is in storage or in use as an upright cleaner for floor care purposes. When use of the hose 34 is desired, the outer flange 60 need merely be rotated between 90° and 180° as shown in FIG. 3, allowing for the two wraps of the hose 34 previously retained thereby to be quickly removed axially from such retention. In like manner, the double wraps contained within the middle retainer 32 may be quickly dispensed from the associated channels. Concurrently, the hose 34 disengages the spool of the bottom hose mount 30. Then, the operator need only remove the hose end 36 from the socket or receptacle of the nipple 52 and connect the hose end 38 into an opening provided in the vacuum cleaner housing. A clip 41 or other appropriate means maintains the necessary interconnection. A vacuum pressure is thus available at the end 36 of the hose 34 for cleaning activity, using the end 36 alone, or with appropriate tools attached thereto. Above floor cleaning, such as drapes, ceilings, furniture and the like may thus be undertaken with the upright cleaner 10.

When the cleaning activity is completed, the flange 60 may be rotated such that the boss 68 and detent 66 engage. The end 38 is detached from the vacuum cleaner housing by release of the latch 41 or other appropriate means and the hose end 36 is inserted into the receptacle bore 54 of the nipple 52. The hose is then brought into receipt by an appropriate one of the channels of the hose retainer 32, wrapped around the top retainer 28, back through the opposite channel of the retainer 32, around the spool of the bottom hose mount 30, again through the first mentioned channel of the hose retainer 32, again over the top hose mount 28, and back into the hose retainer 32 to complete the spiral wrap shown in FIG. 2. The hose 34 is thus spirally wrapped and vertically stacked upon itself to preferably be retained within the profile of the cleaner head and to be unobstructive to cleaning activity.

The invention herein has been presented with respect to a hose rack maintained on a side of the upright vacuum cleaner 10. However, the concept of the invention is readily extended to other mountings of the rack, such as on the rear of the cleaner.

Thus it can be seen that the objects of the invention have been satisfied by the structure presented above. While in accordance with the patent statutes only the best mode and preferred embodiment of the invention have been presented and described in detail, it is to be understood that the invention is not limited thereto or thereby. Accordingly, for an appreciation of the true scope and breadth of the invention reference should be made to the following claims.

What is claimed is:

1. A hose and rack assembly for an upright vacuum cleaner, comprising:

a) a hose having a first and second ends;

b) support means attached to the vacuum cleaner for receiving and maintaining said hose, said first end of said hose being connected to said support means, said support means including means pivotally mounted to said upright cleaner for pivoting to effect a quick release of said hose from said support means;

c) said support means comprising spaced apart top and bottom hose mounts, said hose being wrapped therebetween;

d) said top hose mount comprising outer and inner spaced apart flanges receiving said hose therebetween, said outer flange being rotatable about an axis;

e) a shaft mounted to a handle of said upright cleaner and extending transversely outwardly therefrom, said outer and inner flanges received upon said shaft outwardly of said handle for said upright cleaner; and f) said outer flange and said shaft having a mating detent and boss restricting and permitting rotation of said outer flange relative to said shaft about said axis to thereby provide said release means.

2. The hose and rack assembly according to claim 1, wherein said support means receives said hose in a spiral overlapped wrap.

3. A hose and rack assembly for an upright vacuum cleaner, comprising:

a) a hose having a first and second ends;

b) support means attached to the vacuum cleaner for receiving and maintaining said hose, said first end of said hose being connected to said support means, said support means including release means pivotally mounted to said upright cleaner for pivoting to effect a quick release of said hose from said support means;

c) said support means comprising spaced apart top and bottom hose mounts, said hose being wrapped therebetween;

d) said bottom hose mount comprising a spool of generally cylindrical shape; and e) said spool has an attached nipple receiving and retaining said first end of said hose in telescoping relationship thereby facilitating spiral wrapping of the hose.

4. The hose and rack assembly according to claim 3, wherein said support means receives said hose in a spiral overlapped wrap.

5. The hose and rack assembly according to claim 3, wherein said top hose mount comprises outer and inner spaced apart flanges receiving said hose therebetween, said outer flange being rotatable about an axis to thereby form said release means.

6. A hose and rack assembly for an upright vacuum cleaner, comprising:

a) a hose having a first and second ends;

b) support means attached to the vacuum cleaner for receiving and maintaining said hose, said first end of said hose being connected to said support means, said support means including release means pivotally mounted to said upright cleaner for pivoting to effect a quick release of said hose from said support means;

c) said support means receiving said hose in a spiral overlapped wrap;

d) said support means comprising spaced apart top and bottom hose mounts, said hose being wrapped therebetween;

e) said top hose mount comprising outer and inner spaced apart flanges receiving said hose therebetween, said outer flange being rotatable about an axis;

f) said bottom hose comprises a spool of generally cylindrical shape;

g) said support means further comprising a retainer interposed between said top and bottom hose mounts, said hose passing through and being retained by said retainer;

h) said retainer has first and second side by side channels; said first channel receiving said hose passing from said bottom hose mount to said top hose mount; and said second channel receiving said hose passing from said top hose mount to said bottom hose mount.

7. The hose and rack assembly according to claim 6, wherein said top and bottom hose mounts and said retainer extend from a side of the vacuum cleaner.

8. In an upright vacuum cleaner, the improvement of a hose and rack assembly comprising:

a) a top hose receptacle;

b) a bottom hose receptacle;

c) a middle hose receptacle interpositioned between said top and bottom hose receptacles;

d) a hose having a first end thereof connected to the bottom hose receptacle and being spirally wrapped around the top and bottom hose receptacles and received within said middle hose receptacle;

e) said top hose receptacle having a rotatable portion, said hose being quickly and easily released from said top hose receptacle upon rotation of said rotatable portion;

f) said bottom hose receptacle comprising a spool; said first end of said hose being connected to said spool; and g) said middle hose receptacle being H-shaped, having two pairs of parallel oppositely extending legs forming a pair of oppositely disposed channels.

9. The improvement of a hose and rack assembly according to claim 8, wherein said top hose receptacle comprises a pair of flanges eccentrically mounted on a shaft.

10. The improvement of a hose and rack assembly according to claim 9, wherein said pair of flanges comprises an inner fixed flange and an outer rotatable flange, said rotatable flange comprising said rotatable portion.

11. The improvement of a hose and rack assembly according to claim 8, wherein one of said channels receives portion of said hose extending from said bottom hose receptacle to said top hose receptacle, and another of said channels receives portions of said hose extending from said top hose receptacle to said bottom hose receptacle.

12. The improvement of a hose and rack assembly according to claim 8, wherein said top, bottom, and middle hose receptacles are attached to the vacuum cleaner and extend from a side thereof.

13. A hose and rack assembly for an upright cleaner, comprising:

a hose having first and second end portions, mounted on said hose and rack assembly;

at least a first and a second support on said hose and rack assembly for mounting said hose on said hose and rack assembly;

one of said supports being H-shaped to form a pair of back to back hose reception sections; to thereby lodge said first and second end portions in said one of said supports.

* * * * *